US007478900B2

(12) United States Patent
Hasegawa et al.

(10) Patent No.: US 7,478,900 B2
(45) Date of Patent: Jan. 20, 2009

(54) TONER REMAIN AMOUNT DETECTING METHOD, IMAGE FORMING APPARATUS AND MFP

(75) Inventors: Satoshi Hasegawa, Shizuoka-Ken (JP); Shinya Mori, Shizuoka-Ken (JP); Motoshi Ueda, Shizuoka-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 249 days.

(21) Appl. No.: 11/366,323

(22) Filed: Mar. 1, 2006

(65) Prior Publication Data

US 2007/0206037 A1 Sep. 6, 2007

(51) Int. Cl.
*B41J 2/17* (2006.01)

(52) U.S. Cl. ..... 347/84; 347/7; 399/27

(58) Field of Classification Search ..... 347/84
See application file for complete search history.

(56) References Cited

U.S. PATENT DOCUMENTS 7,010,237 B2 * 3/2006 Suzuki et al. ..... 399/27
7,181,147 B2 * 2/2007 Kinoshita et al. ..... 399/27

FOREIGN PATENT DOCUMENTS

| | | |
|---|---|---|
| JP | 10-207212 | 8/1998 |
| JP | 11-109741 | 4/1999 |
| JP | 2003-149933 | 5/2003 |

* cited by examiner

*Primary Examiner*—Matthew Luu
*Assistant Examiner*—Brian J Goldberg
(74) *Attorney, Agent, or Firm*—SoCal IP Law Group LLP; Steven C. Sereboff; John E. Gunther

(57) ABSTRACT

A toner remain detecting method according to this invention including: detecting toner density; supplying a toner amount corresponding to predetermined toner density; detecting a toner remain amount every time toner supply is carried out; and displaying toner near-empty if the toner remain amount becomes equal to or less than a prescribed value; wherein the toner supply step includes calculating a toner supply amount on the basis of a predetermined toner density level and the toner remain amount detected at the toner remain amount detecting step and supplying toner of the amount calculated at the toner supply amount calculating step. With the toner remain detecting method according to this invention, the toner remain amount can be detected more accurately than in conventional techniques.

6 Claims, 3 Drawing Sheets

| | |
|---|---|
| ABNORMAL TONER DENSITY (HIGH DENSITY) | "ERROR" IS DISPLAYED |
| NORMAL TONER DENSITY | TONER SUPPLY IS NOT CARRIED OUT (NORMAL STATE) |
| TONER DENSITY LEVEL 1 | TONER SUPPLY TIME t1 |
| TONER DENSITY LEVEL 2 | TONER SUPPLY TIME t2 |
| TONER DENSITY LEVEL 3 | TONER SUPPLY TIME t3 |
| ABNORMAL TONER DENSITY (LOW DENSITY) | "ERROR" IS DISPLAYED |

| TONER SUPPLY MODE | TONER DENSITY | SUPPLY TIME | PREDETERMINED TONER SUPPLY AMOUNT | | |
|---|---|---|---|---|---|
| | | | X~A | A~B | B~C |
| FIRST TONER SUPPLY MODE | Level1 | t1 | $a_{A1}$ | $a_{B1}$ | $a_{C1}$ |
| SECOND TONER SUPPLY MODE | Level2 | t2 | $a_{A2}$ | $a_{B2}$ | $a_{C2}$ |
| THIRD TONER SUPPLY MODE | Level3 | t3 | $a_{A3}$ | $a_{B3}$ | $a_{C3}$ |

TONER REMAIN AMOUNT DETECTING METHOD, IMAGE FORMING APPARATUS AND MFP

BACKGROUND OF THE INVENTION

1. Technical Field of the Invention

The present invention relates to a toner remain amount detecting method, an image forming apparatus and MFP, and particularly to a toner remain amount detecting method, an image forming apparatus and MFP that are capable of detecting the toner remain amount with higher accuracy.

2. Related Art

Conventionally, there are JP-A-10-20721 and JP-A-2003-149933 as known examples related to detection of a toner remain amount by estimation from a toner supply amount.

JP-A-10-20721 discloses an image forming apparatus and a toner remain amount detecting method in which, on the basis of a toner near-empty judgment value or a judgment value, an actual toner supply amount per supply is calculated from the count value of the number of times of toner supply up to a current point of time and the first toner filling amount from a toner cartridge, and then the toner supply amount per supply is modified to a prescribed value or the number of times of toner supply is modified while leaving the toner supply amount unchanged.

However, in the image forming apparatus disclosed in JP-A-10-20721, the toner supply amount per supply is calculated by determining near-empty state, and a sensor for detecting the toner remain amount must be prepared. Therefore, for example, in the case of a color image forming apparatus, a sensor must be provided in each developer and the apparatus becomes more expensive.

Meanwhile, JP-A-2003-149933 discloses an image forming apparatus having a counter that collects number-of-rotation information of a toner supply device which supplies toner to a developing device by rotation, a storage unit that saves the number-of-rotation information of the toner supply device, and a calculating unit that calculates a toner use amount or toner remain amount of the toner supply device on the basis of the number-of-rotation information saved in the storage unit, and a method of correcting the number of rotations of the toner supply device and thus calculating the toner use amount.

However, it is confirmed by the results of experiment that the correct toner remain amount cannot necessarily be detected even if the number of rotations is corrected on the basis of a toner supply mechanism including a toner cartridge supply port, a motor, a clutch and the like, or the toner remain amount in the cartridge at the time of supply, as in the image forming apparatus and the toner remain amount detecting method disclosed in JP-A-2003-149933.

Thus, a toner remain amount detecting method, an image forming apparatus and MFP that are capable of detecting the toner remain amount with higher accuracy are demanded.

SUMMARY OF THE INVENTION

This invention has been made in view of the foregoing circumstances, and it is an object of this invention to provide a toner remain amount detecting method, an image forming apparatus and MFP that are capable of detecting the toner remain amount with higher accuracy.

A toner remain amount detecting method according to this invention includes: detecting toner density; supplying a toner amount corresponding to predetermined toner density if the toner density detected at the toner density detecting step is less than a prescribed value; subtracting the supplied toner amount and thus detecting a toner remain amount every time toner supply is carried out; and displaying toner near-empty state if the toner remain amount detected at the toner remain amount detecting step becomes equal to or less than the prescribed value. The toner supply step includes calculating a toner supply amount on the basis of a predetermined toner density level and the toner remain amount detected at the toner remain amount detecting step and supplying toner of the amount calculated at the toner supply amount calculating step. Therefore, the toner remain amount can be detected with higher accuracy than in the conventional techniques.

Further, an image forming apparatus and MFP according to this invention each includes: an image forming unit configured to form an image on a photoconductor by using toner; a paper feeding unit configured to supply paper; a transfer unit configured to transfer the image formed by the image forming unit to a paper supplied from the paper feeding unit; a fixing unit configured to fix the image transferred to the paper; a paper ejecting unit configured to eject the paper on which the image has been fixed by the fixing unit; a toner remain amount detecting unit configured to detect a remain amount of the toner by subtracting a toner supply amount per toner supply from an initial toner amount; and a display unit configured to display a fact that the toner is near empty, if the toner remain amount detecting unit determines that the toner is near empty; wherein the toner supply amount changes on the basis of a predetermined toner density level and the toner remain amount detected by the toner remain amount detecting unit. Therefore, the toner remain amount can be detected with higher accuracy than in the conventional techniques.

DETAILED DESCRIPTION OF THE PREFERRED EMBODIMENTS

An embodiment of the toner remain amount detecting method and the image forming apparatus according to this invention will be described with reference to the attached drawings.

Figures 1, 2:
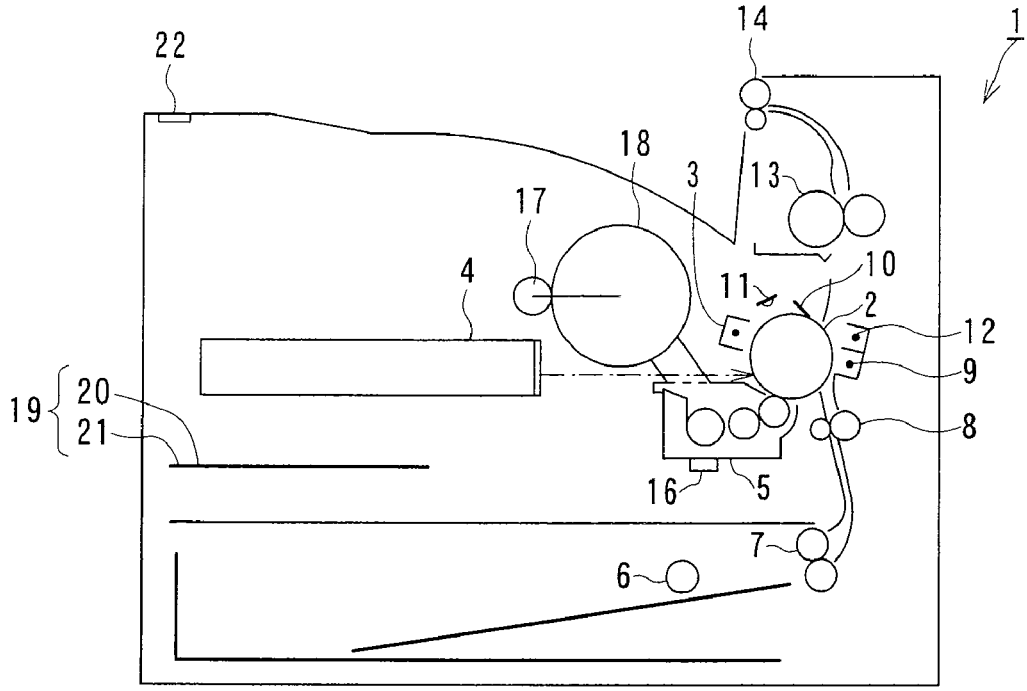
FIG. 1 is a view schematically showing the structure of an image forming apparatus according to the present invention.
FIG. 2 is a view for explaining an example of toner density level set in the image forming apparatus according to the present invention.

FIG. 1 is a view schematically showing the structure of an image forming apparatus 1, which is an example of the image forming apparatus according to this invention.

In the image forming apparatus 1, when forming an image, a photoconductor 2 is charged by a charger 3, and the photoconductor 2 is scanned by a laser beam cast from an exposure unit 4, thus forming an electrostatic latent image. Then, a developer 5 forms an image by using toner.

The image formed on the photoconductor 2 is transferred by a transfer unit 9 to a recording paper that is supplied from a paper feeding unit 6 through a transport unit 7 and a registration unit 8. The toner that is not transferred and is left on the photoconductor 2 is cleaned by a cleaning unit 10. The charge on the charged photoconductor 2 is eliminated by a static eliminating lamp 11.

The recording paper, on which the image has been transferred, passes through the static eliminating unit 12 in order to be detached from the photoconductor 2. Then, after fixing is performed by a fixing unit 13, the recording paper is ejected from a paper ejecting unit 14.

During the series of operations in the image forming, a toner density detecting unit 16 mounted on the developer 5 monitors the toner density. When the toner density is lowered, a toner supply unit 17 supplies toner from a toner cartridge 18.

A control unit 19 controls the series of devices related to the image forming.

The control unit 19 has a toner remain amount detecting unit 20 that detects the toner remain amount, and a toner empty detecting unit 21 that determines toner empty state.

The control unit 19 has information about the number of times of toner supply, and the toner remain amount, and information for deciding the toner supply amount (equivalent to FIG. 5, which will be described later). It decides the toner supply amount in accordance with the toner density and the toner remain amount at the time of toner supply, and controls the toner supply unit 17.

The information of the toner supply amount decided by the control unit 19 is sent to the toner remain amount detecting unit 20, and the toner remain amount detecting unit 20 calculates the toner remain amount. The information of the toner remain amount held by the control unit 19 is updated every time the toner remain amount detecting unit 20 calculates the toner remain amount. When the toner remain amount becomes less than a preset value, the toner remain amount detecting unit 20 determines that the toner is near empty. The information that the toner is near empty is sent from the toner remain amount detecting unit 20 to a display unit 22 and is displayed on the display unit 22.

The toner empty detecting unit 21 counts the number of times that the toner supply is repeated in the state where the toner density is equal to or less than a predetermined level, and determines that the toner is empty when the count exceeds a predetermined number. The information that the toner is empty is sent from the toner empty detecting unit 21 to the display unit 22 and is displayed on the display unit 22.

While FIG. 1 shows the case of the image forming apparatus, the same applies to MFP (Multi Function Peripherals) having an image forming function similar to the image forming apparatus 1.

FIG. 2 is a view for explaining an example of toner density level set in the image forming apparatus 1.

The toner density level is classified, for example, into abnormal toner density and normal toner density, as shown in FIG. 2. Abnormal toner density may be higher or lower than the normal toner density range. If abnormal toner density is detected as a result of detecting the toner density by the toner density detecting unit 16, the display unit 22, having received information that the toner density is abnormal from the toner density detecting unit 16, performs error display.

Normal toner density is divided into plural levels, for example, four levels, and level 0 (within a prescribed value) to level 3 are set in descending order of density. If level 0 is detected as a result of detecting the toner density by the toner density detecting unit 16, the toner density is within the prescribed range and therefore toner supply is not carried out.

If level 1 to level 3 are detected, the time for supplying toner is decided in order to carry out toner supply corresponding to each level.

It is described that, in FIG. 2, if level 1 to level 3 are detected as a result of detecting the toner density by the toner density detecting unit 16, the time for supplying toner is decided in order to carry out toner supply. However, the rotation angle of the toner supply unit 17 may be decided, instead of the time for supplying toner.

Figure 3:
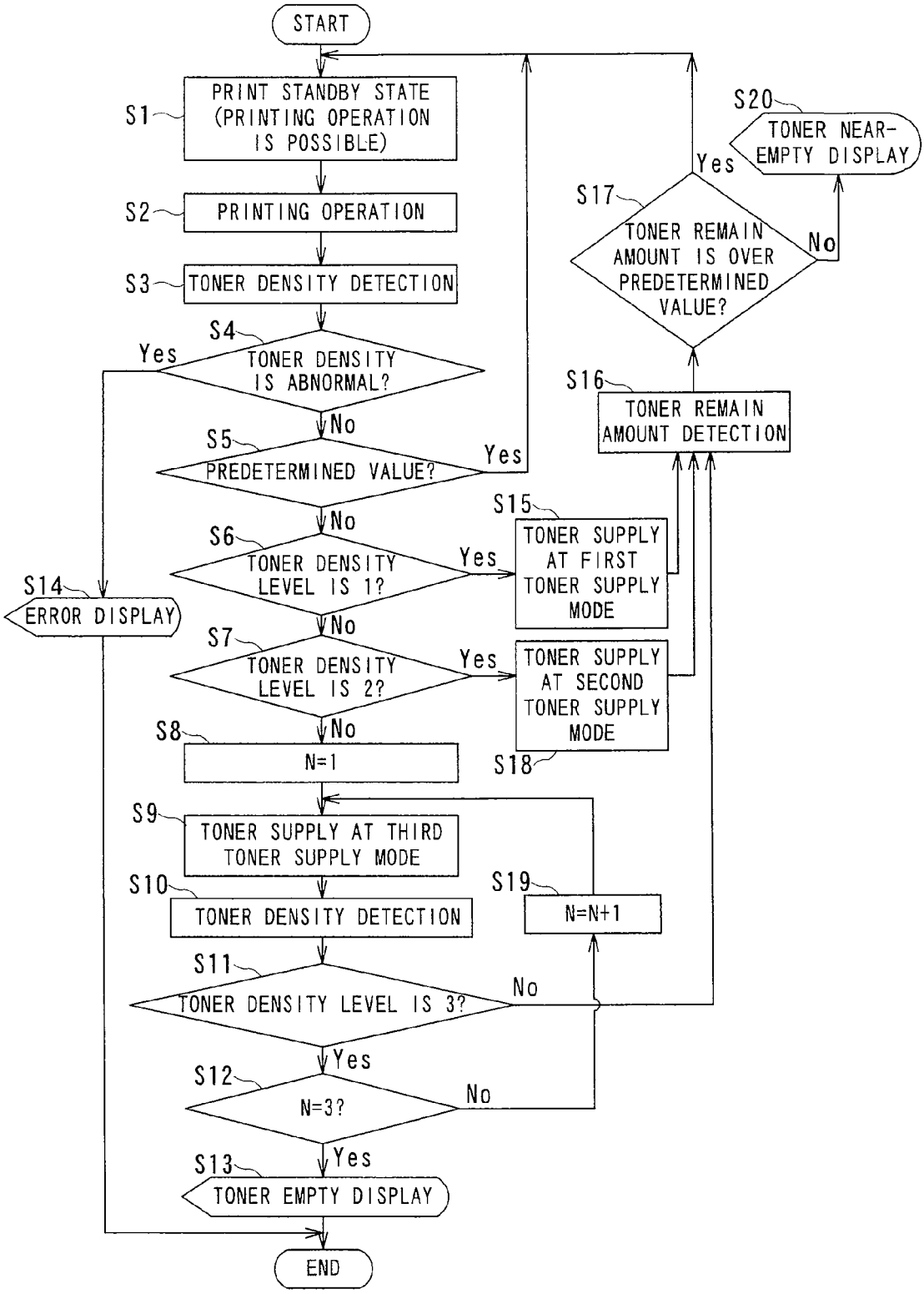
FIG. 3 is a flowchart for explaining a toner remain amount detecting method according to the present invention.

FIG. 3 is a flowchart for explaining a toner empty detecting step as the toner remain amount detecting method according to this invention.

The toner empty detecting step shown in FIG. 3 includes a processing step to detect not only toner empty state but also near-empty state.

According to FIG. 3, the toner empty detecting step includes a toner density detecting step (step S3), a toner supply step (step S9, step S15, step S18) of supplying toner in accordance with the toner density if the toner density detected at the toner density detecting step is less than a prescribed value (NO at step S4), a toner remain amount detecting step (step S16) of detecting the toner remain amount every time the toner supply step is executed, a toner near-empty display step (step S20) of displaying toner near-empty if the toner remain amount detected at the toner remain amount detecting step is equal to or less than a prescribed value (NO at step S17), and a toner empty display step (step S13) of displaying the fact that the toner is empty, if the toner density is less than the prescribed value (YES at step S12) even though a predetermined amount of toner is supplied a predetermined number of times.

At the toner empty detecting step, first, the processing is started (START) by turning on the power of the image forming apparatus 1 and a print standby state is set (step S1). Next, as a print operation is carried out (step S2), the toner density detecting step is carried out at step S3.

At the toner density detecting step (step S3), the toner density detecting unit 16 detects the toner density. If abnormal toner density is not detected (NO at step S4) but the toner density within a prescribed value is not maintained (equivalent to level 1 to level 3) (NO at step S5) as a result of the toner density detection, the processing goes to step S6.

If the toner density level is level 3 (NO at step S6, NO at step S7), N representing the number of times of toner supply at toner density level 3 (hereinafter, referred to as level 3 toner supply) is set to 1 at step S8. Then, at step S9, the toner supply unit 17 supplies toner from the toner cartridge 18.

The toner supply amount per unit time is decided on the basis of the toner density level detected by the toner density detecting unit 16 and the toner remain amount detected by the toner remain amount detecting unit 20.

Subsequently, at step S10, the toner density detecting unit 16 detects the toner density after the supply. If the toner density after the level 3 toner supply is level 3 (YES at step S11) and the value N is 3 (YES at step S12), the fact that the toner is empty is displayed on the display unit 22, and the user is requested to replace the toner cartridge 18 (step S13). As the fact that the toner is empty is displayed on the display unit 22, the toner empty detecting step is completed (END).

On the other hand, if abnormal toner density is detected (YES at step S4) as a result of the toner density detection, an error is displayed on the display unit 22 (step S14) and the toner empty detecting step is completed (END).

If abnormal toner density is not detected (NO at step S4) and the toner density within the prescribed value is maintained (YES at step S5) as a result of the toner density detection, the processing returns to step S1 and the processing steps of step S1 and the subsequent steps are executed. That is, the toner supply unit 17 does not carry out toner supply.

If toner density level 1 is detected (YES at step S6) as a result of the toner density detection, the toner supply unit 17 supplies toner from the toner cartridge 18 (hereinafter referred to as level 1 toner supply) (step S15). The toner supply amount is decided similarly to step S9.

After the toner supply, the processing goes to step S16 and the toner remain amount is detected. If the remaining toner amount is equal to or more than a preset prescribed value (YES at step S17) as a result of detecting the toner remain amount, the processing returns to step S1 and the processing steps of step S1 and the subsequent steps are executed.

If toner density level 2 is detected (YES at step S7) as a result of the toner density detection, the toner supply unit 17 supplies toner from the toner cartridge 18 (hereinafter referred to as level 2 toner supply) (step S18). The toner supply amount is decided similarly to step S9.

After the toner supply, the processing goes to step S16 and the toner remain amount is detected. If the remaining toner amount is equal to or more than a preset prescribed value (YES at step S17) as a result of detecting the toner remain amount, the processing returns to step S1 and the processing steps of step S1 and the subsequent steps are executed.

If the toner density after the level 3 toner supply is not level 3 at step S11 (NO at step S11), the processing goes to step S16 and the toner remain amount is detected. If the remaining toner amount is equal to or more than a preset prescribed value (YES at step S17) as a result of detecting the toner remain amount, the processing returns to step S1 and the processing steps of step S1 and the subsequent steps are executed.

Moreover, if the toner density after the level 3 toner supply is level 3 (YES at step S11) and the value N is not 3 (NO at step S12), 1 is added to N (step S19) and the processing returns to step S9. Then, the processing steps of step S9 and the subsequent steps are executed.

Meanwhile, if the toner remain amount detected at the toner remain amount detecting step is equal to or less than a prescribed value (NO at step S17), toner near-empty is displayed on the display unit 22 (step S20), and the toner empty detecting step is completed (END).

While the value N is assumed to be 3 at step S12, any arbitrary natural number equal to or larger than 2 may be used.

Next, the toner supply amount that is supplied at the toner supply step and the method of detecting toner near-empty will be described.

When a time for supplying has been decided, the toner supply amount is expressed by the product of the toner supply time and the toner supply amount per unit time. When a rotation angle of the toner supply unit has been decided, the toner supply amount may be expressed by the product of the rotation angle of the toner supply unit and the toner supply amount per unit angle. In this invention, the toner supply amount per unit time or per unit angle, which is conventionally constant irrespective of the toner remain amount, is changed in accordance with the toner remaining amount.

The reason for this is that the toner use amount cannot necessarily be calculated by correcting the number of rotations because of the toner cartridge supply port, the toner supply mechanism including a motor, clutch and the like, and the toner remain amount within the cartridge at the time of supply, and therefore the accurate toner remain amount cannot be detected. Also, it is because it is confirmed by the results of experiment that the toner supply amount is not necessarily proportional to the toner supply time (see FIG. 4).

Thus, in this invention, the toner supply amount that is appropriate to each toner supply time (toner supply amount per unit time) is set in advance in order to detect the remain amount. Here, each toner supply time is decided in accordance with the toner density level detected by the toner density detecting unit 16.

Figures 4, 5:
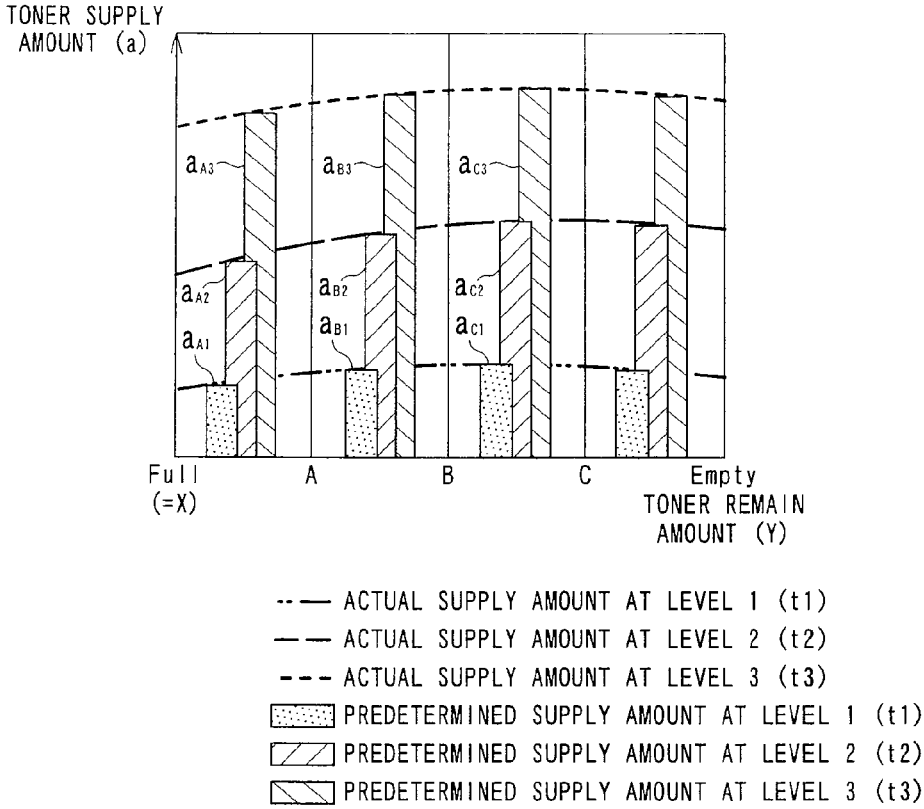
FIG. 4 is a view showing the relation between the toner supply mode corresponding each toner supply time (t1 to t3) in the image forming apparatus and the toner supply amount per unit time corresponding to the toner remain amount, on the basis of the results of experiment.
FIG. 5 is a view showing the toner supply amount per unit time for each toner remain amount range in each toner supply mode provided from the results of experiment shown in FIG. 4.

FIG. 4 is a view showing the relation between the toner supply mode (first toner supply mode for carrying out level 1 toner supply, second toner supply mode for carrying out level 2 toner supply, and third toner supply mode for carrying out level 3 toner supply) corresponding to each toner supply time (t1 to t3) in the image forming apparatus 1, and the toner supply amount per unit time corresponding to the toner remain amount.

According to FIG. 4, which is acquired by experiment, if focusing on each toner supply mode (first toner supply mode to third toner supply mode) with respect to each of 4 ranges of toner remain amounts, from a toner initial filling state (Full) X to an empty state (Empty), for example, of X to A, A to B, B to C, and C to Empty, the toner supply amount per unit time differs from range to range. In short, it means that the toner supply amount per unit time changes depending on the toner remain amount.

FIG. 5 is a view showing the toner supply amount per unit time for each toner remain amount range in each toner supply mode acquired from the results of experiment shown in FIG. 4.

The detailed calculation of the toner remain amount carried out in this invention will be described with reference to FIG. 5.

It is assumed that near-empty is detected at point C shown in FIG. 4. First, the toner cartridge in the initial state is loaded and the toner in the developer is consumed in the print operation. As the toner density level is lowered to level 1, the preset value of toner supply amount for level 1 becomes $a_{A1}$ as shown in FIG. 5 because the toner remain amount is between X and A at this point.

When the toner density is lowered to level 2, the preset value of the toner supply amount becomes $a_{A2}$. When the toner density is lowered to level 3, the preset value of the toner supply amount becomes $a_{A3}$. If the number of times of supply is $n_{A1}$, $n_{A2}$, $n_{A3}$ until the toner remain amount changes from X to A, the toner use amount $Z_A$ is expressed by the following equation 1,

[Equation 1]

$$Z_A = a_{A1}n_{A1} + a_{A2}n_{A2} + a_{A3}n_{A3} \quad (1)$$

where $Z_A$ is the integrated value of the toner use amount for the remain amount X to A;

$a_{A1}$ is the toner supply amount (supply level 1) (for the toner remain amount X to A);

$a_{A2}$ is the toner supply amount (supply level 2) (for the toner remain amount X to A);

$a_{A3}$ is the toner supply amount (supply level 3) (for the toner remain amount X to A);

$n_{A1}$ is the number of times of supply (supply level 1) (for the toner remain amount X to A);

$n_{A2}$ is the number of times of supply (supply level 2) (for the toner remain amount X to A); and $n_{A3}$ is the number of times of supply (supply level 3) (for the toner remain amount X to A).

The toner remain amount is expressed by the following equation 2 by using $Z_A$ expressed by the equation 1,

[Equation 2]

$$Y=X-Z_A \quad (2)$$

where Y is the toner remain amount in the toner cartridge, and X is the initial filling amount in the toner cartridge.

As the toner is consumed further and it becomes Y<A, and if the preset value of the toner supply amount for level 1 is $a_{B1}$, the preset value of the toner supply amount for level 2 is $a_{B2}$, the preset value of the toner supply amount for level 3 is $a_{B3}$, and the number of times of supply is $n_{B1}$, $n_{B2}$, $n_{B3}$, the toner use amount $Z_B$ is expressed by the following equation 3,

[Equation 3]

$$Z_B=a_{B1}n_{B1}+a_{B2}n_{B2}+a_{B3}n_{B3} \quad (3)$$

where $Z_B$ is the integrated value of the toner use amount for the remain amount A to B;

$a_{B1}$ is the toner supply amount (supply level 1) (for the toner remain amount A to B);

$a_{B2}$ is the toner supply amount (supply level 2) (for the toner remain amount A to B);

$a_{B3}$ is the toner supply amount (supply level 3) (for the toner remain amount A to B);

$n_{B1}$ is the number of times of supply (supply level 1) (for the toner remain amount A to B);

$n_{B2}$ is the number of times of supply (supply level 2) (for the toner remain amount A to B); and $n_{B3}$ is the number of times of supply (supply level 3) (for the toner remain amount A to B).

Similarly, if the toner remain amount becomes Y<B, the toner use amount $Z_C$ is expressed by the following equation 4,

[Equation 4]

$$Z_C=a_{C1}n_{C1}+a_{C2}n_{c2}+a_{C3}n_{C3} \quad (4)$$

where $Z_C$ is the integrated value of the toner use amount for the remain amount B or less;

$a_{C2}$ is the toner supply amount (supply level 2) (for the toner remain amount B or less);

$a_{C3}$ is the toner supply amount (supply level 3) (for the toner remain amount B or less);

$a_{C1}$ is the toner supply amount (supply level 1) (for the toner remain amount B or less);

$n_{C1}$ is the number of times of supply (supply level 1) (for the toner remain amount B or less);

$n_{C2}$ is the number of times of supply (supply level 2) (for the toner remain amount B or less); and $n_{C3}$ is the number of times of supply (supply level 3) (for the toner remain amount B or less).

Therefore, the toner remain amount Y is expressed by equation 5, and the toner becomes near empty when Y<C holds.

[Equation 5]

$$Y=X-(Z_A+Z_B+Z_C) \quad (5)$$

According to this invention, a dedicated detecting unit for detecting the toner remain amount is not necessary. Also, as a table of preset values is formed, the toner remain amount detection control corresponding to any toner supply device can be varied by using the table preset values without changing the program, and the remain amount detection with higher accuracy is possible.

This invention is not limited to each of the above-described embodiments, and at the stage of carrying out the invention, its constituent elements can be modified in implementation without departing from the scope of the invention.

What is claimed is:

1. A toner remaining amount detecting method comprising:

detecting a toner density level;

supplying a toner if the detected toner density level is less than a prescribed toner density value;

calculating a supplied toner amount as the product of a toner supply time decided in accordance with the detected toner density level and a toner supply amount per unit time, wherein the toner supply amount per unit time changes in accordance with a toner remaining amount before the toner supply is carried out;

subtracting the supplied toner amount from the toner remaining amount before the toner supply is carried out, in the case of supplying the toner, and thus detecting the toner remaining amount every time toner supply is carried out; and displaying toner near-empty if the toner remaining amount becomes equal to or less than a prescribed toner remaining value.

2. The toner remain amount detecting method as claimed in claim 1, further comprising displaying a fact that toner is empty if the toner density level is less than the prescribed toner density value despite that a predetermined amount of toner is supplied a predetermined number of times.

3. The toner remain amount detecting method as claimed in claim 1, wherein the toner supply time is a value selected in accordance with the detected toner density level from a plurality of preset values.

4. A toner remaining amount detecting method comprising:

detecting a toner density level;

supplying a toner if the detected toner density level is less than a prescribed toner density value;

calculating a supplied toner amount as the product of a rotation angle of a toner supply unit decided in accordance with the detected toner density level and a toner supply amount per unit angle, wherein the toner supply amount per unit angle changes in accordance with a toner remaining amount before the toner supply is carried out;

subtracting the supplied toner amount from the toner remaining amount before the toner supply is carried out, in the case of supplying the toner, and thus detecting the toner remaining amount every time toner supply is carried out; and displaying toner near-empty if the toner remaining amount becomes equal to or less than a prescribed toner remaining value.

5. The toner remaining amount detecting method as claimed in claim 4, further comprising:

displaying a fact that toner is empty if the toner density level is less than the prescribed toner density value despite that a predetermined amount of toner is supplied a predetermined number of times.

6. The toner remaining amount detecting method as claimed in claim 4, wherein the rotation angle of a toner supply unit is a value selected in accordance with the detected toner density level from a plurality of preset values.

* * * * *